US005275031A

United States Patent [19]

Whiteside et al.

[11] Patent Number: 5,275,031

[45] Date of Patent: Jan. 4, 1994

[54] BEND CORRECTION APPARATUS AND METHOD

[75] Inventors: James A. Whiteside, Russellville; Billy W. Morgan, Dardanelle, both of Ark.

[73] Assignee: Stark Manufacturing, Inc., Russellville, Ark.

[21] Appl. No.: 893,714

[22] Filed: Jun. 5, 1992

[51] Int. Cl.[5] ..... B21D 7/04

[52] U.S. Cl. ..... 72/10; 72/149; 72/702; 72/369

[58] Field of Search ..... 72/8, 9, 702, 10, 21, 72/22, 149, 369

[56] References Cited

U.S. PATENT DOCUMENTS

| | | | |
|---|---|---|---|
| 3,352,136 | 11/1967 | Clarke | 72/9 |
| 3,440,847 | 4/1969 | Giordano | 72/12 |
| 3,459,018 | 8/1969 | Miller | 72/7 |
| 3,653,251 | 4/1972 | Coonan | 72/369 |
| 3,821,525 | 6/1974 | Eaton et al. | 235/151.1 |
| 4,122,697 | 10/1978 | Hanyo et al. | 72/128 |
| 4,262,511 | 4/1981 | Boisvert et al. | 71/17 |
| 4,476,702 | 10/1984 | Zängerle | 72/15 |
| 4,563,802 | 1/1986 | Benteler et al. | 29/157 |
| 4,587,832 | 5/1986 | Illgutk | 72/12 |
| 4,649,726 | 3/1987 | Trammell et al. | 72/34 |
| 4,864,509 | 9/1989 | Somerville et al. | 364/476 |
| 4,947,666 | 8/1990 | Hametner et al. | 72/37 |
| 4,979,385 | 12/1990 | LaFrasse et al. | 72/10 |
| 5,007,264 | 4/1991 | Haack | 72/702 |
| 5,050,089 | 9/1991 | Stelson et al. | 364/474.07 |
| 5,060,495 | 10/1991 | Naoomi et al. | 72/10 |

FOREIGN PATENT DOCUMENTS

| | | | |
|---|---|---|---|
| 0384477 | 8/1990 | European Pat. Off. | 72/702 |
| 0092120 | 5/1984 | Japan | 72/702 |
| 1386330 | 4/1988 | U.S.S.R. | 72/702 |
| 8701625 | 3/1987 | World Int. Prop. O. | 72/702 |

*Primary Examiner*—Lowell A. Larson
*Assistant Examiner*—Michael J. McKeon
*Attorney, Agent, or Firm*—Senniger, Powers, Leavitt & Roedel

[57] ABSTRACT

A bend correction apparatus for bending a workpiece subject to springback, the apparatus having a pressure die for holding a workpiece, a radius die for providing a radius form about which the workpiece is bent, and a clamping die for engaging and bending the workpiece relative to the pressure die and about a portion of the radius die. A microprocessor moves the clamping die between a bend angle position in which the workpiece is bent about the radius die to a predetermined angle relative to the clamping die and a relieved position in which the clamping die is not bending the workpiece. A sensor, movable conjointly with the radius die, engages the workpiece in a springback position upon rotation of the radius die toward the workpiece and sends a signal to the microprocessor upon contact with the workpiece. The microprocessor then determines a rebend angle to achieve the desired degree of bend in the workpiece and moves the clamping die means and radius die to the rebend angle to bend the workpiece to that angle and storing the rebend angle for bending subsequent workpieces.

13 Claims, 4 Drawing Sheets

BEND CORRECTION APPARATUS AND METHOD

BRIEF SUMMARY OF THE INVENTION

This invention relates generally to metal forming machines, and more particularly to an apparatus for bending a workpiece subject to springback, such as metal tubing or conduit.

Presently, there are metal forming machines capable of bending tubing (which are subject to springback) and detecting the amount of springback present in the tubing after the bend is made. One such metal forming machine may be found in U.S. Pat. No. 3,352,136, which discloses a metal forming machine having a radius bend die, a pressure die, and a clamp die for forming a bend in the tubing. After an initial bend is formed in the tubing, the clamp die is moved away from the radius bend die, and a springback detector, pivotally mounted to a bending arm (which moves the clamp die) adjacent a sidewall of the bent tubing, pivots to engage the sidewall of the tubing to align itself therewith. The detector assumes an angle identical to the angle of the bend to determine the amount of springback in the tubing, and an encoder sends a digital signal indicative of the degree of springback of the tubing to a master sequencer. The master sequencer then determines a corrected bend angle and alters the relative positions of the dies for rebending the tubing to the corrected angle. These steps are then repeated until the springback detector does not detect a springback angle.

In U S. Pat. No. 3,352,136, the springback detector is a pair of spaced apart sensing fingers of unitary construction which are pivotally mounted on the bending arm. The detector must be located out of the path of the tubing during the bending operation and is pivotable to a position in which it is adjacent the tubing after the bend is completed and the clamp die is moved away from the radius bend die. The detector is first adjusted to assume a position adjacent the wall of the tubing which corresponds to no springback. The fingers are then moved to engage the wall of the workpiece and are then rotated an amount corresponding to the degree of springback. The detector utilized in U.S. Pat. No. 3,352,136 is deficient in that the detector itself must be rotated out of the way during the bending procedure, otherwise it would interfere with the bend being made in the tubing. The necessary movement and part fitting tolerances introduce possible error and make the rebend angle calculations more difficult and subject to error.

Accordingly, among the several objects of this invention may be noted the provision of a bend correction apparatus which is capable of quickly and efficiently detecting the amount of springback in the workpiece; the provision of such a bend correction apparatus which rebends the workpiece to a corrected bend angle upon detecting the amount of springback in the workpiece; the provision of such a bend correction apparatus which does not use a movable probe relative to the radius die; the provision of such a bend correction apparatus which stores the corrected bend angle for bending subsequent workpieces; and the provision of such a bend correction apparatus which is durable, simple in construction for economical manufacture and easy to use.

Generally, the bend correction apparatus of this invention comprises a pressure die for holding a workpiece, a radius die for providing a radius form about which the workpiece is bent, and a clamping die for engaging and bending the workpiece relative to the pressure die and about a portion of the radius die. Control means moves the clamping die between a bend angle position in which the workpiece is bent about the radius die to a predetermined angle relative to the clamping die and a relieved position in which the clamping die is not bending the workpiece. Sensor means, movable conjointly with the radius die, engages the workpiece in a springback position upon rotation of the radius die toward the workpiece and sends a signal to the control means upon contact with the workpiece. The control means then determines a rebend angle to achieve the desired degree of bend in the workpiece and moves the clamping die means and radius die to the rebend angle to bend the workpiece to that angle and storing the rebend angle for bending subsequent workpieces.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
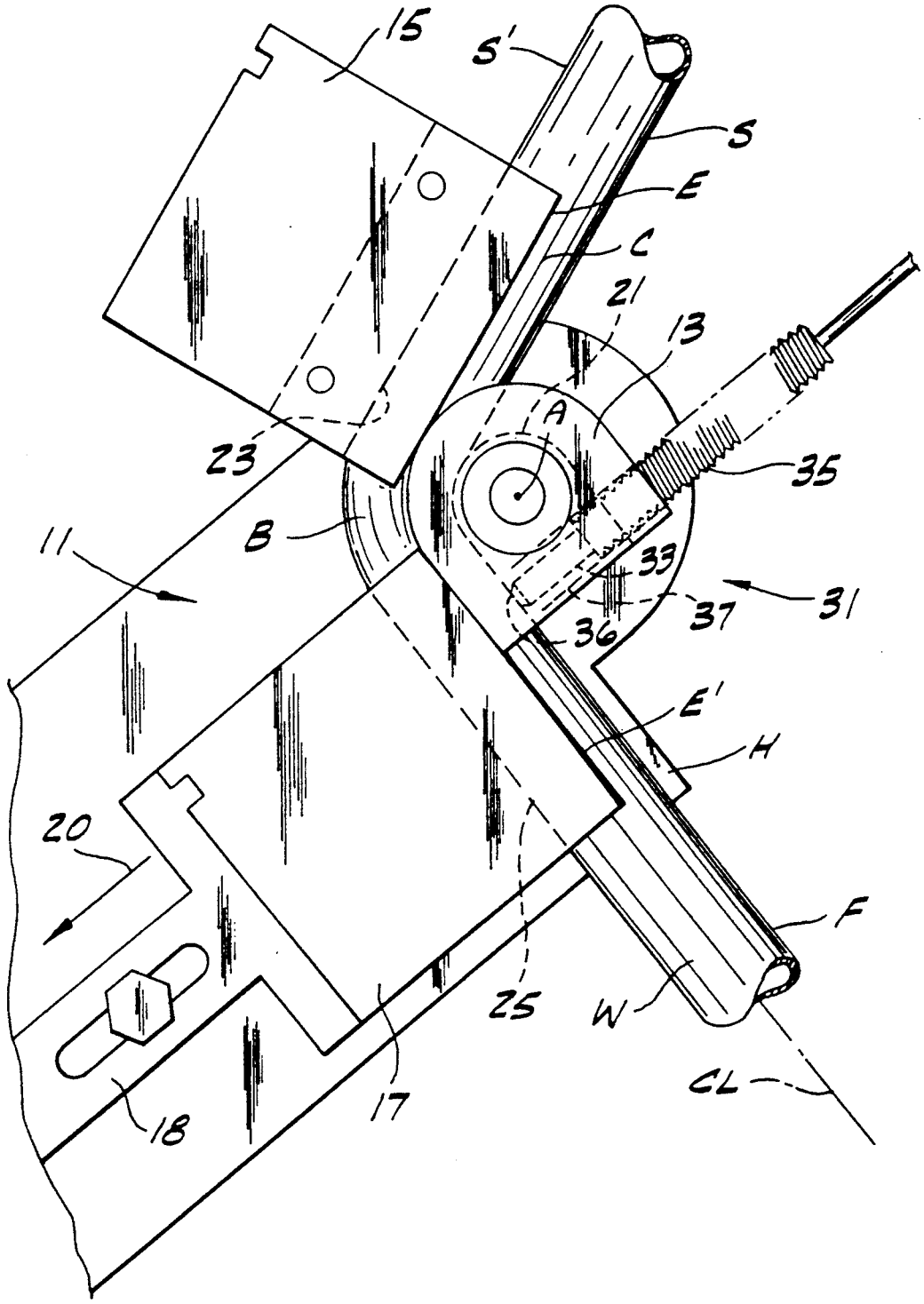
FIG. 1 is a schematic of a bend correction apparatus of the present invention showing a bend being made in a workpiece.

Turning now to the drawings and more particularly to FIG. 1, there is generally shown at 11 a bend correction apparatus of the present invention for bending a workpiece W, such as metal tubing or conduit, which is subject to springback. Springback is the degree to which the workpiece W returns to its original shape after a forming operation has been performed thereon. The springback angle is the difference between the actual bend angle in a workpiece that has been freed from one end thereof and the desired degree of bend. For every bend made in the workpiece W, its physical properties (e.g., elastic nature) forces the bent portion B of the workpiece to attempt to return it to its original shape due to the release of stress on the workpiece. Thus, to obtain a desired degree of bend, the workpiece W must be bent beyond the desired degree of bend to compensate for springback present in the workpiece. However, the initial bend should not be made to such a degree that the angle of bend when the piece is freed is beyond the desired bend angle since most metal forming machines are incapable of bending the workpiece the opposite way. Thus, the desired degree of bend must be approached cautiously by forming multiple, incremental bends in the workpiece.

Bend correction apparatus 11 generally comprises a radius die or block 13, a pressure die 15, and a clamping die 17 for forming a bend in the workpiece W. As shown, the radius block 13 is generally U-shaped as viewed from above and is pivotable about an axis A extending centrally through the radius block. The radius block has a groove 21 extending around its perimeter for receiving and conforming to the side S of the workpiece W. If the workpiece is tubular as shown in the drawings, groove 21 has a radius corresponding to the radius of the workpiece W, thus, multiple radius blocks can be provided for accommodating workpieces having varying radii. Alternatively, inserts (not shown), having varying radii corresponding to those of the workpieces to be bent, may be secured in a recess in place of groove 21. A housing H pivots the radius block 13 about axis A through a range of movement for bending the workpiece W.

Pressure die 15 is positioned adjacent radius block 13 for holding or clamping the workpiece W at a bent portion B between itself and the radius block. More specifically, the pressure die 15 is positioned adjacent the bottom of the "U" of the U-shaped radius block. The pressure die 15 is rectangular in shape and has a straight edge E for wiping engagement of the other side S' of the workpiece W as the workpiece is fed between the radius block and the pressure die. Like radius block 13, pressure die 15 has a groove 23 along edge E which corresponds to groove 21 of the radius block. As with groove 21, groove 23 has a radius corresponding to the radius of the workpiece W, and multiple pressure dies may be provided for accommodating workpieces having varying radii. An arm and associated hydraulic or pneumatic equipment (not shown), attached to the backside of the pressure die 15, moves the pressure die from an engaging position in which the groove 23 engages the workpiece W between the pressure die and the radius block to a non-engaging position in which the pressure die is spaced away from the workpiece and the radius block. As shown in the drawings, the pressure die 15 engages the radius block 13, with the workpiece W held securely between them. During the bending of a workpiece, the pressure die 15 engages and maintains pressure on the workpiece W during the entire bending operation.

Like the pressure die 15, clamping die 17 is rectangular in shape and has a straight edge E' for engaging the other side S' of the workpiece W. The clamping die is positioned adjacent the radius block 13 such that edge E is parallel to the straight line portion of the "U" defined on one side of the U-shaped radius block. A groove 25, having the same radius as grooves 21 and 23, is provided in the clamping die 17 for engaging the workpiece between the itself and the radius block 13. As with the radius block 13 and the pressure die 15, multiple clamping dies are available for engaging workpieces with varying radii. The clamping die 17 is moved by an arm 18 and associated hydraulic or pneumatic equipment (not shown) from a workpiece engaging or bend angle position to a workpiece non-engaging or relieved position In its engaging position, the clamping die 17 engages the workpiece W between itself and the radius block 13 and the workpiece is bent about the radius block to a predetermined angle relative the clamping die. In its non-engaging position, the clamping die 17 is moved by the arm 18 in the direction of arrow 20 to a position in which it is spaced from the workpiece W so that the workpiece can be easily removed from the tube bending apparatus. As shown in the drawings, the clamping die 17 engages the radius block 13, with the workpiece W held securely between them.

The clamping die 17 and the radius block 13 are each mounted on housing H so that the clamping die is pivotal conjointly with the radius block. Thus, the clamping die 17 engages the workpiece W between itself and the radius block 13 at the same position (i.e., groove 25 of the clamping die always remains parallel to groove 21 of the radius block), independent of the angle being formed in the workpiece. A bend is formed in the workpiece W by generally wrapping the workpiece around the radius block, the pressure and clamping dies 15, 17, respectively, ensuring the workpiece engages groove 21 of the radius block.

Figure 2:
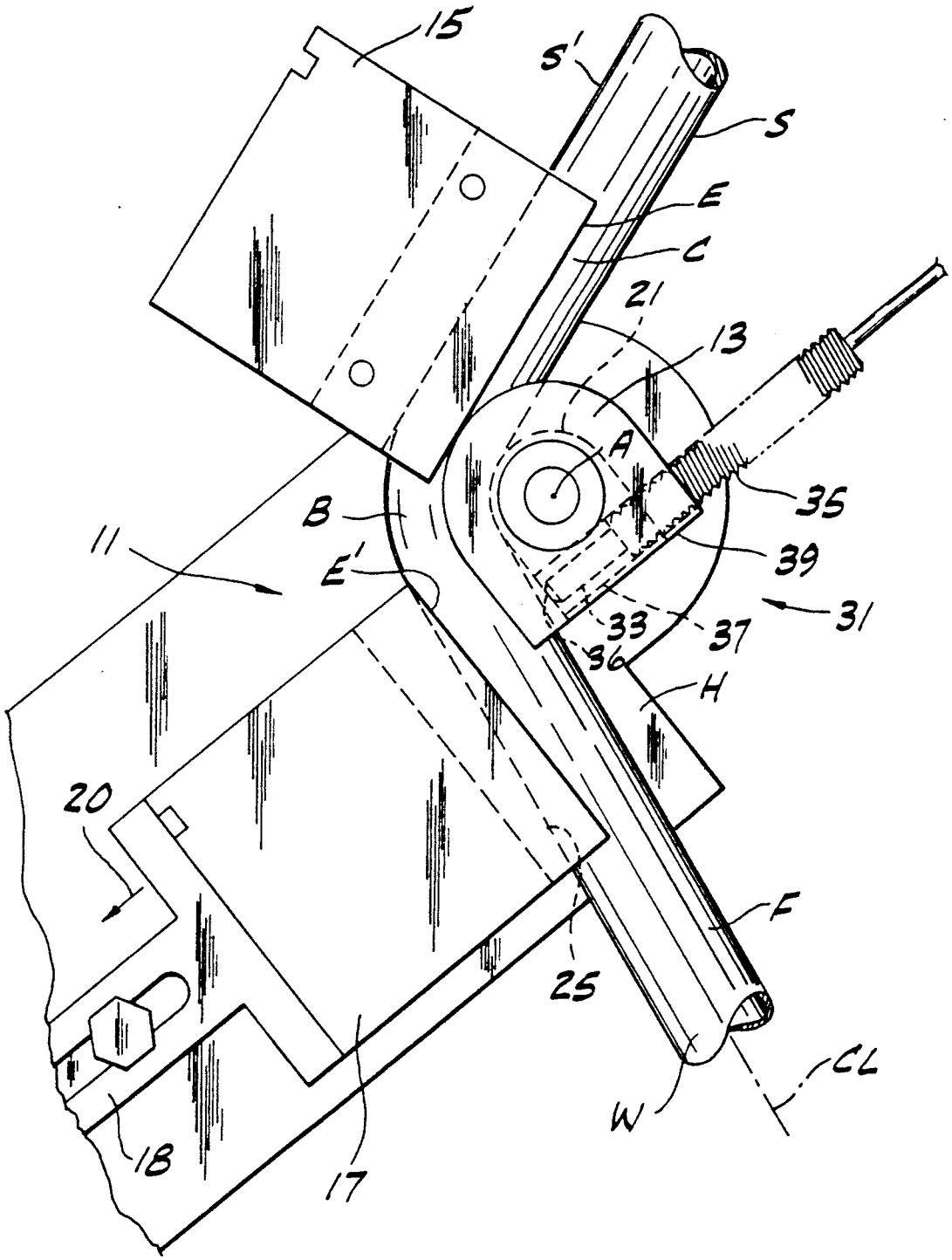
FIG. 2 is a schematic of the bend correction apparatus showing a clamping die (which in part forms the bend in the workpiece) in a non-engaging position relative the workpiece.

In bending the workpiece W, it is first fed by a chuck (not shown) which feeds and positions the workpiece between the pressure die 15, the clamping die 17 and the radius block 13 such that the radius block is on one side S of the workpiece, and the pressure and clamping dies are on the other side S' of the workpiece. The pressure and clamping dies 15, 17 are in their non-engaging positions when the workpiece W is initially fed therein. Next, the pressure and clamping dies 15, 17 are moved by their respective moving arms (not shown) to their workpiece engaging positions. After the movement of the pressure and clamping dies 15 and 17, the radius block 13 and the clamping die are rotated about axis A such that the desired degree of bend may be formed in the workpiece W by generally wrapping the workpiece around the radius block. After the bend is made in the workpiece W, the clamping die 17 is moved to its non-engaging position for determining the amount of springback in the workpiece W which will be described hereinafter. In this position, the workpiece W has a held or clamped portion C, a bent portion B (described above) and a free portion F. As shown in FIG. 2, the angle formed between the bent portion B and the free portion F (indicated by centerline CL) compared to the desired degree of bend (parallel to the straight edge of the radius block), defines the amount of springback in the workpiece. Controlling the bending operation, broadly control means, is a microprocessor (not shown) as is generally known in the art of bending forming machines. The microprocessor, in addition to moving the radius block 13 and pressure die 15, moves the clamping die 17 from its bend angle position (engaging) in which the workpiece is bent about the radius block 13 to a predetermined angle relative to the clamping die to its relieved position (non-engaging) in which the clamping die is not bending the workpiece.

Figure 3:
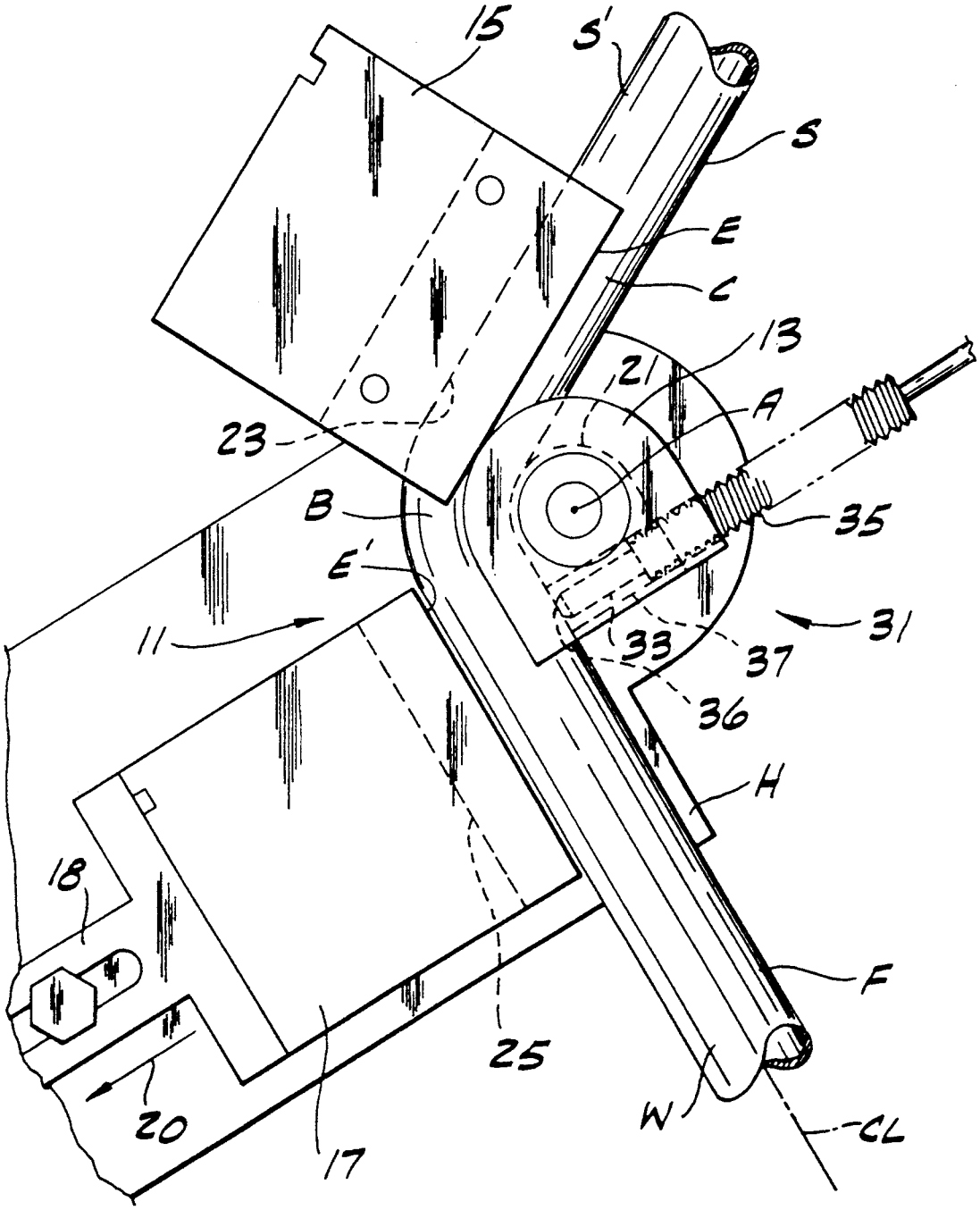
FIG. 3 is a schematic as shown in FIG. 2 with a radius block pivoted towards the workpiece such that a sensor mounted thereon detects a portion of the workpiece.

A detector or sensor, generally designated 31 detects the free portion F of the workpiece W for determining the amount of springback in the workpiece. More specifically, detector 31 is a low voltage contact sensor having a contact point 33 insulated from an outside threaded housing 35. Radius block 13 has a tapped hole 37 extending therethrough to the base of the U-shaped groove 21. The detector 31 is screwed into the tapped hole 37 of the radius block 13 and is adjusted therein to a position where the flat end surface 36 of the contact point 33 is tangent the radiused groove 21 so as to engage the workpiece W when it is positioned in the groove. Detector 31 is pivotal conjointly with the radius block 13 since it is mounted thereon. As shown in FIG. 1, when the clamping die 17 is in its workpiece engaging position, the contact point 33 of detector 31 just touches side S of the workpiece. Also, since the detector 31 is pivotal conjointly with the radius block 13, if the clamping die 17 is in its workpiece nonengaging position, the radius block may pivot about axis A to a position where the contact point 33 touches the side S of the workpiece W (see FIG. 3). Apparatus 11 is grounded so that when the contact point 33 touches the workpiece W, a low voltage circuit (e.g., 12 volts) is completed. Completion of this circuit sends a signal to the microprocessor, which is programmed to stop the radius block 13 from pivoting, and at such time, the springback angle may be analyzed by simply determining the position of the radius block. Alternatively, detector 31 may be used in an opposite mode where as soon as the contact point 33 disengages the workpiece W, the circuit is broken and the microprocessor is programmed to stop the radius block 13 from pivoting and the springback angle may be determined. In this mode, the detector 31 normally engages the workpiece W in a springback position after a bend is made in the workpiece and the clamping die 17 moves to its relieved position. The detector 31 rotates away from the workpiece W upon rotation of the radius block 13 away from the workpiece and sends a signal to the microprocessor upon disengaging the workpiece. The microprocessor then determines a rebend angle to achieve the desired degree of bend in the workpiece W and moves the clamping die 17 and radius block 13 to the rebend angle to bend the workpiece to that angle.

To detect the springback angle after a first bend is made in the workpiece W, the clamping die 17 moves to its non-engaging position as shown in FIG. 2. In this position, the free end F of the workpiece moves away from the radius block groove 21 from which it was engaged when the bend was being made to a position where it is generally between the radius block 13 and the clamping die 17. This movement is caused by the springback in the workpiece W. Generally, when the first bend is being made in the workpiece W, the microprocessor is programmed so that the bending apparatus 11 forms a bend in the workpiece which results in an angle less than the desired bend angle. For example, if a forty-five degree bend is required, the microprocessor is programmed to pivot the radius block 13, and move the pressure and clamping dies 15, 17 to form a forty-five degree bend in the workpiece W. Depending on the amount of springback of the workpiece W (which in turn depends on the elasticity of the workpiece), the resulting bend will not be forty-five degrees, but may range from forty to forty-three degrees (e.g., forty-two degrees). To determine the amount of springback, the radius block 13 pivots so that the contact point 33 of the detector 31 engages the side S of the free end F of the workpiece W. Upon touching side S, the detector 31 completes the low voltage circuit and the microprocessor stops the radius block 13 from pivoting further. The angular orientation of the radius block (which corresponds identically to the bend actually formed in the workpiece) is then determined by the microprocessor and compared to the desired degree of bend so that the microprocessor can determine a correcting bend angle.

After determining the correcting bend angle, the apparatus forms a second bend in the workpiece W and the cycle repeats itself. In the example given above, if the resulting degree of bend after bending the workpiece W forty-five degrees is forty-two degrees, the microprocessor is programmed to form a second bend in the workpiece of forty-eight degrees (forty-five degrees plus three degrees). After this bend is made, the clamping die 17 again moves to its workpiece non-engaging position and the radius block 13 pivots towards the free end F of the workpiece to a position where the detector 31 senses the side S of the workpiece. If, for example, the resulting degree of bend after the second bend is forty-four degrees (one degree shy of the desired degree of bend, e.g., forty-five degrees), the apparatus then forms a third bend in the workpiece W of forty-nine degrees (forty-eight degrees plus one degree). Apparatus 11 then determines whether the resulting angle is within its acceptable range of tolerances. If for example, the bend angle is forty-four and one-half degrees, the bend may be acceptable, in which case the workpiece W is fed by the chuck to form another bend in the workpiece if necessary.

After bending the workpiece W to its desired degree of bend, the microprocessor is programmed to calculate and retain a new bend angle related to the final bend angle used in bending the workpiece. This is known in the art of bending apparatus as a "teach mode" in which the apparatus, based on bending prior workpieces, retains a bend angle for bending subsequent workpieces which will achieve the desired bend angle with a single bend and thereby eliminate having the apparatus form multiple bends in all workpieces. In the example given above, the last bend angle was forty-nine degrees which achieved the desired bend angle within an acceptable tolerance. The initial bend angle of forty-five degrees contained in the microprocessor memory would be replaced by a bend angle somewhere between the initial bend angle and the final bend angle to compensate for springback in the workpiece. It would not be the full forty-nine degrees because that is the degree of bend that was necessary because of work-hardening of the initial workpiece due to multiple bends of that workpiece. Since there would be no workhardening of subsequent workpieces due to multiple bending, a single bend of forty-nine degrees in subsequent workpieces would result in overbending the workpieces. Thus, the final bend angle of the original workpiece must be factored down, depending on the material being bent, in order to obtain the desired bend angle in subsequent workpieces. For example, for an aluminum workpiece, it has been found that the actual bend angle for subsequent workpieces is preferably factored down to approximately seventy-five percent of the final bend angle of the original workpiece. Therefore, in the example, the bend angle for all subsequent workpieces would be forty-eight degrees, which is the difference between the initial or desired bend angle and the final bend angle in the original workpiece multiplied by 0.75, which is then added to the desired bend angle ($49°-45°=4°\times0.75=3°+45°=48°$). The microprocessor is therefore programmed to factor down the final bend angle of an original workpiece while in the teach mode by the appropriate percentage depending upon the material of the workpiece.

Figure 4:
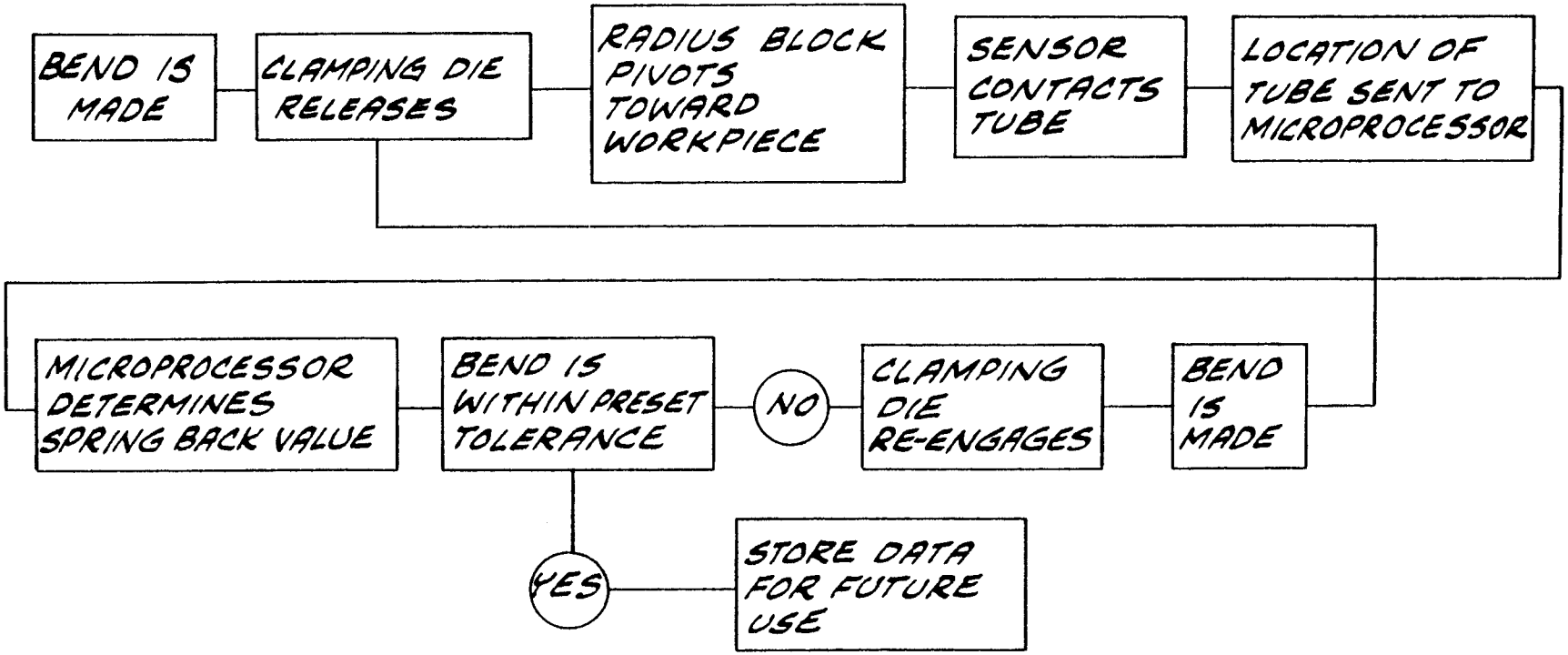
FIG. 4 is a block diagram showing the operation cycle of the apparatus.

The sequence of operation is generally shown in FIG. 4. In this sequence, a bend is formed in the workpiece W and the clamping die 17 is then moved to its non-engaging position. The radius block 13 then pivots to a point where the contact point 33 for detector 31 engages side S of the workpiece W. The location of the workpiece W is sent to the microprocessor which is programmed to determine the springback angle and compare it to the desired degree of bend to determine whether the bend is within an acceptable tolerance. If the bend is not acceptable, the apparatus forms another bend in the workpiece W. After the bend is made, the previous steps are performed until the bend is within an acceptable tolerance. If acceptable, the final bend angle is stored in the microprocessor for bending subsequent workpieces.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A workpiece bending apparatus for automatically bending a workpiece having springback characteristics to a desired angle, comprising:

a pressure die means for holding a workpiece, a radius die means for providing a radius form about which the workpiece is bent, the radius die means being adapted to rotate about an axis for bending the workpiece about the radius die means to a predetermined angle, a workpiece clamping die means for engaging and bending the workpiece relative to the pressure die means and about a portion of the radius die means, control means for moving the clamping die means between a bend angle position in which the workpiece is bent about the radius die means to said predetermined angle relative to the clamping means and a relieved position in which the clamping die means is not bending the workpiece, and sensor means movable conjointly with the radius die means for engaging the workpiece in a springback position upon rotation of the radius die means toward the workpiece when said clamping die means is in its relieved position and for sending a signal to the control means upon contact with the workpiece, said sensor being stationary relative to the radius die means as the radius die means rotates, said control means then determining a rebend angle to achieve the desired degree of bend in the workpiece and moving said clamping die means to its bend angle position and rotating the radius die means to the rebend angle to bend the workpiece to that angle and storing the rebend angle for bending subsequent workpieces.

2. An apparatus as set forth in claim 1 wherein said control means comprises a microprocessor.

3. An apparatus as set forth in claim 1 wherein said radius die means comprises a groove with an inner edge formed therein for receiving a side of the workpiece, said sensor means comprising a contact point adjacent the inner edge for detecting the side of the workpiece.

4. An apparatus as set forth in claim 3 wherein said sensor means comprises a low voltage contact sensor mounted on said radius die means at a position such that the contact point is tangent the inner edge formed in the groove so as to engage the side of the workpiece when it is positioned in the groove, thereby completing a circuit in which a signal is sent to said control means for stopping the rotation of said radius die means and determining said rebend angle.

5. An apparatus as set forth in claim 4 wherein said sensor is adjustable relative to the radius die means to extend from a position recessed within the inner edge of the groove to a position beyond the inner edge of the groove.

6. A method of determining the correct bend angle when forming a workpiece subject to springback, the method comprising:

bending the workpiece with bending means comprising pressure die means for holding a workpiece, radius die means for providing a radius form about which the workpiece is bent, the radius die means being adapted to rotate about an axis for bending the workpiece about the radius die means to a predetermined angle, and workpiece clamping die means for engaging and bending the workpiece relative to the pressure die means and about a portion of the radius die means;

controlling said bending means by control means for moving the clamping die means between a bend angle position in which the workpiece is bent about the radius die means to said predetermined angle relative to the clamping means and a relieved position in which the clamping die means is not bending the workpiece; and sensing the free portion of the workpiece by sensor means, said sensor means movable conjointly with the radius die means for engaging the workpiece in a springback position upon rotation of the radius die means toward the workpiece when said clamping die means is in its relieved position and for sending a signal to the control means upon contact with the workpiece, said sensor being stationary relative to the radius die means as the radius die means rotates, said control means then determining a rebend angle to achieve the desired degree of bend in the workpiece and moving said clamping die means to its bend angle position and rotating the radius die means to the rebend angle to bend the workpiece to that angle and storing the rebend angle for bending subsequent workpieces.

7. A method as set forth in claim 6 further comprising the step of rebending said workpiece after sensing the amount of springback in the workpiece to a corrected bend angle.

8. A method as set forth in claim 7 further comprising the step of replacing the desired degree of bend with the correcting bend angle for rotating the radius die means to the corrected bend angle for bending subsequent workpieces.

9. A workpiece bending apparatus for automatically bending a workpiece having springback characteristics to a desired angle, comprising:

a pressure die means for holding a workpiece, a radius die means for providing a radius form about which the workpiece is bent, the radius die means being adapted to rotate about an axis for bending the workpiece about the radius die means to a predetermined angle, a workpiece clamping die means for engaging and bending the workpiece relative to the pressure die means and about a portion of the radius die means, control means for moving the clamping die means between a bend angle position in which the workpiece is bent about the radius die means to said predetermined angle relative to the clamping means and a relieved position in which the clamping die means is not bending the workpiece, and sensor means movable conjointly with the radius die means, said sensor means normally engaging the workpiece in a springback position after a bend is made in the workpiece and the clamping die means moves to its relieved position and rotates away from the workpiece upon rotation of the radius die means away from the workpiece and sends a signal to the control means upon disengaging the workpiece, said sensor being stationary relative to the radius die means as the radius die means rotates, said control means then determining a rebend angle to achieve the desired degree of bend in the workpiece and moving said clamping die means to its bend angle position and rotates the radius die means to the rebend angle to bend the workpiece to that angle and storing the rebend angle for bending subsequent workpieces.

10. An apparatus as set forth in claim 9 wherein said control means comprises a microprocessor.

11. An apparatus as set forth in claim 9 wherein said radius die means comprises a groove with an inner edge formed therein for receiving a side of the workpiece, said sensor means comprising a contact point adjacent the inner edge for detecting the side of the workpiece.

12. An apparatus as set forth in claim 11 wherein said sensor means comprises a low voltage contact sensor mounted on said radius die means at a position such that the contact point is tangent the inner edge formed in the groove so as to engage the side of the workpiece when it is positioned in the groove thereby completing a circuit, and, when the contact point disengages the workpiece, the circuit is broken and a signal is sent to said control means for stopping the rotation of said radius die means and determining said rebend angle.

13. An apparatus as set forth in claim 12 wherein said sensor is adjustable relative to the radius die means to extend from a position recessed within the inner edge of the groove to a position beyond the inner edge of the groove.

* * * * *